US008845129B1

(12) United States Patent
Holder et al.

(10) Patent No.: US 8,845,129 B1
(45) Date of Patent: Sep. 30, 2014

(54) METHOD AND SYSTEM FOR PROVIDING AN ARRAY OF MODULAR ILLUMINATION SOURCES

(75) Inventors: Ronald G. Holder, Laguna Niguel, CA (US); Matthew A. Davis, Orange, CA (US)

(73) Assignee: Cooper Technologies Company, Houston, TX (US)

( * ) Notice: Subject to any disclaimer, the term of this patent is extended or adjusted under 35 U.S.C. 154(b) by 52 days.

(21) Appl. No.: 13/556,036

(22) Filed: Jul. 23, 2012

Related U.S. Application Data

(60) Provisional application No. 61/510,346, filed on Jul. 21, 2011.

(51) Int. Cl.
*F21V 13/04* (2006.01)
*F21S 4/00* (2006.01)
*F21V 29/00* (2006.01)

(52) U.S. Cl.
USPC ..... 362/245; 362/218; 362/249.02; 362/294; 362/308; 362/328; 362/331; 362/373

(58) Field of Classification Search
USPC ..... 362/245, 246, 331, 249.02–249.06, 362/218, 294, 308, 309, 328, 373
See application file for complete search history.

(56) References Cited

U.S. PATENT DOCUMENTS

| | | | | |
|---|---|---|---|---|
| 4,460,945 | A | 7/1984 | Chan | |
| 4,729,076 | A | 3/1988 | Masami | |
| 5,490,049 | A * | 2/1996 | Montalan et al. | 362/240 |
| 5,782,555 | A | 7/1998 | Hochstein | |
| 5,857,767 | A | 1/1999 | Hochstein | |
| 6,227,684 | B1 | 5/2001 | Wijbenga | |
| 6,796,680 | B1 * | 9/2004 | Showers et al. | 362/246 |
| 6,891,200 | B2 * | 5/2005 | Nagai et al. | 257/88 |
| 7,063,440 | B2 * | 6/2006 | Mohacsi et al. | 362/240 |
| 7,090,370 | B2 | 8/2006 | Clark | |

(Continued)

FOREIGN PATENT DOCUMENTS

| | | |
|---|---|---|
| CN | 2750186 | 1/2006 |
| CN | 1737418 | 2/2006 |
| DE | 202006015981 | 1/2007 |

OTHER PUBLICATIONS

Aoyama, Y.; Yachi, T., "An LED Module Array System Designed for Streetlight Use," Energy 2030 Conference, 2008. Energy 2008. IEEE , vol., no., pp. 1-5, Nov. 17-18, 2008, doi: 10.1109/ENERGY.2008.4780996; URL: http://ieeexplore.ieee.org/stamp/stamp.jsp?tp=&arnumber=4780996&isnumber=4780986.

(Continued)

*Primary Examiner* — Alan Cariaso
(74) *Attorney, Agent, or Firm* — King & Spalding LLP

(57) ABSTRACT

A method and system for providing an array of illumination modules is disclosed. A modular illumination system can comprise a one-dimensional array, a two-dimensional array, or other shapes and arrangements of the illumination modules. Adjacent illumination modules in the array can be attached to one another via a system of connectors. Each illumination module can comprise at least two connectors, one feeding electricity to a neighboring illumination module and one receiving electricity from a power source. The power source can comprise another neighboring illumination module or a power supply circuit that feeds the array of illumination modules or a subset of illumination modules in the array. Each illumination module can comprise a circuit board, at least one LED, and an optical system that manages light.

19 Claims, 13 Drawing Sheets

(56) References Cited

U.S. PATENT DOCUMENTS

| | | | | |
|---|---|---|---|---|
| 7,237,936 | B1 | 7/2007 | Gibson | |
| 7,329,030 | B1 | 2/2008 | Wang | |
| 7,329,033 | B2 | 2/2008 | Glovatsky | |
| 7,348,604 | B2 | 3/2008 | Matheson | |
| 7,513,639 | B2 | 4/2009 | Wang | |
| 7,569,802 | B1 | 8/2009 | Mullins | |
| 7,572,027 | B2 | 8/2009 | Zampini, II | |
| 7,575,354 | B2 | 8/2009 | Woodward | |
| 7,637,633 | B2 | 12/2009 | Wong | |
| 8,360,608 | B2 * | 1/2013 | Wildner | 362/249.04 |
| 8,721,115 | B2 * | 5/2014 | Ing et al. | 362/245 |
| 2007/0019415 | A1 | 1/2007 | Leblanc | |
| 2007/0081338 | A1 | 4/2007 | Kuan | |
| 2007/0258214 | A1 | 11/2007 | Shen | |
| 2008/0019129 | A1 | 1/2008 | Wang | |
| 2008/0043473 | A1 | 2/2008 | Matsui | |
| 2008/0055908 | A1 | 3/2008 | Wu | |
| 2008/0068799 | A1 | 3/2008 | Chan | |
| 2008/0080188 | A1 | 4/2008 | Wang | |
| 2009/0244895 | A1 | 10/2009 | Chen | |
| 2009/0262543 | A1 | 10/2009 | Ho | |
| 2009/0323334 | A1 * | 12/2009 | Roberts et al. | 362/247 |

OTHER PUBLICATIONS

Petroski, J.; Norley, J.; Schober, J.; Reis, B.; Reynolds, R.A.; , "Conduction cooling of large LED array systems," Thermal and Thermomechanical Phenomena in Electronic Systems (ITherm), 2010 12th IEEE Intersociety Conference on , vol., no., pp. 1-10, Jun. 2-5, 2010; doi: 10.1109/ITHERM.2010.5501350; URL: http://ieeexplore.ieee.org/stamp/stamp.jsp?tp=&arnumber=5501350&isnumber=5501251.

Wankhede, M.; Khaire, V.; Goswami, A.; Mahajan, S.D.; , "Evaluation of Cooling Solutions for Out-door Electronics," Electronics Packaging Technology Conference, 2007. EPTC 2007. 9th , vol., no., pp. 858-863, Dec. 10-12, 2007; doi: 10.1109/EPTC.2007.4469682; URL: http://ieeexplore.ieee.org/stamp/stamp.jsp?tp=&arnumber=4469682&isnumber=4469670.

* cited by examiner

End View

2' X 2' Configuration
Estimated wattage – 160
Estimated Lumens - 11200

2' X 2' Configuration
(exploded)

Simulation Results, Oversize Grayscale

Simulation Results, 8.5 Square Target Zone

METHOD AND SYSTEM FOR PROVIDING AN ARRAY OF MODULAR ILLUMINATION SOURCES

RELATED APPLICATIONS

This application claims priority under 35 U.S.C. §119 to U.S. Provisional Patent Application No. 61/510,346, filed Jul. 21, 2011, titled "Method and System for Providing an Array of Modular Illumination Sources." The foregoing application is hereby incorporated herein in its entirety. This application also incorporates herein by reference in its entirety the disclosure in U.S. Pat. No. 7,674,018, issued Mar. 9, 2010.

FIELD OF THE TECHNOLOGY

The present technology relates to illumination systems and more specifically to an array of illumination modules, wherein each module can include a light emitting diode, an associated optical system that manages light from the diode, and a housing.

BACKGROUND

Light emitting diodes (LEDs) are useful for indoor and outdoor illumination, as well as other applications. Many such applications would benefit from improved technology for producing uniform LED illumination.

A need exists for a system of modular LED units that can be readily integrated with one another to provide a one- or two-dimensional array with the number of units in the array selected according to parameters of a specific installation or application. A need further exists for a system that can distribute electrical power among modular LED units in such an array. A need further exists for a system that can manage light from each LED unit in the array so the array provides uniform, consistent, and/or ambient lighting. A capability addressing one or more of such needs, or some other related deficiency in the art, would support effective deployment of LEDs for lighting and other applications.

SUMMARY

The present technology can support an array of modular light sources providing uniform illumination for an area, for example mounted from a ceiling to illuminate a MOM.

In one aspect of the present technology, a modular illumination system comprises an array of illumination modules. The array can be a two-dimensional array or a one-dimensional array. Adjacent illumination modules in the array can be attached to one another via a system of connectors. Each illumination module can comprise at least two connectors, one feeding electricity to a neighboring illumination module and one receiving electricity from a power source. The power source can comprise another neighboring illumination module or a power supply circuit that feeds the array of illumination modules or a subset of illumination modules in the array. Each illumination module can comprise a respective enclosure that houses a circuit board, at least one LED, and an optical system that manages light. The optical system can comprise a first lens that receives light from the LED and a diffuser and/or a second lens that processes light received from the first lens. The first or second lenses can comprise a Fresnel lens.

In another aspect, a modular illumination system comprises an array of illumination modules. Each illumination module in the array can comprise a circuit board on which is mounted a light emitting diode. A lens can be mounted over the light emitting diode. A concave reflector can be disposed adjacent to the lens. The concave reflector can comprise a cavity that receives light from the lens, a reflective surface lining the cavity, and an aperture opposite the lens. The concave reflector also can have a diffuser placed over the aperture.

In yet another aspect, a modular illumination system comprises an array of illumination modules. An illumination module in the array can comprise a circuit board on which is mounted a light emitting diode. The circuit board can have a first electrical connector attached to one edge and a second electrical connector attached to another edge. The illumination module can further comprise an optic oriented to receive light from the light emitting diode. A first electrical connector of one illumination module of the array can connect to a second electrical connector of another illumination module in the array.

The foregoing discussion of illumination systems is for illustrative purposes only. Various aspects of the present technology may be more clearly understood and appreciated from a review of the following disclosure, including the text, drawings, and claims.

BRIEF DESCRIPTION OF THE DRAWINGS

Reference will now be made to the accompanying drawings, which are not necessarily drawn to scale, and wherein.

Figure 1:
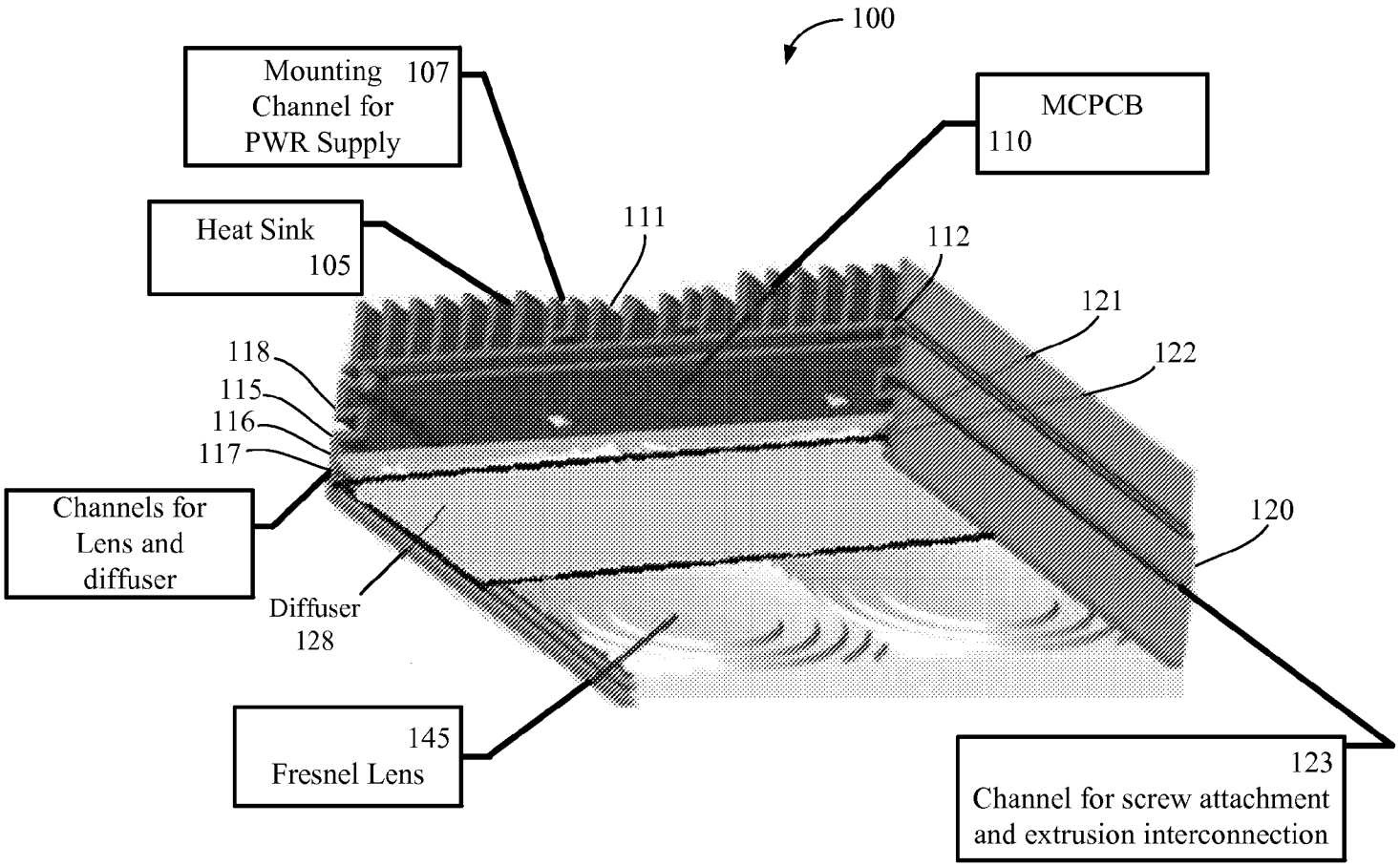
FIG. 1 is a perspective view of a modular illumination element in accordance with an exemplary embodiment of this disclosure.

The drawings illustrate only exemplary embodiments and are therefore not to be considered limiting of its scope, as the disclosure may admit to other equally effective embodiments. The elements and features shown in the drawings are not necessarily to scale, emphasis instead being placed upon clearly illustrating the principles of the exemplary embodiments. Additionally, certain dimensions or positioning may be exaggerated to help visually convey such principles. In the drawings, reference numerals designate like or corresponding, but not necessarily identical, elements.

DESCRIPTION OF EXEMPLARY EMBODIMENTS

The exemplary embodiments are directed to illumination modules that can be assembled in a variety of different shaped arrays. It should be understood that the embodiments described herein can be applied to the construction of various types of light modules, such as those described in U.S. Pat. No. 7,674,018 referenced at the beginning of this patent application and incorporated herein. It will be understood that the devices taught in U.S. Pat. No. 7,674,018 referenced above could be modified to be used in the form of the LED modules described herein.

Exemplary embodiments now will be described more fully hereinafter with reference to the accompanying drawings. This disclosure may, however, be embodied in many different forms and should not be construed as limited to the exemplary embodiments set forth herein; rather, these exemplary embodiments are provided so that this disclosure will be thorough and complete, and will fully convey the scope of the disclosure to persons having ordinary skill in the art. Like numbers refer to like, but not necessarily the same, elements throughout.

Referring now to FIG. 1, an exemplary illumination module 100 is illustrated. Modular illumination element 100 comprises a heat sink 105 attached to a printed circuit board 110, the printed circuit board having mounted thereon four LEDs, two of which, 111 and 112, are visible in FIG. 1. As is known to those skilled in the art, any one of a variety of fasteners and adhesives can be used to attach the heat sink 105 and the printed circuit board 110. In the exemplary embodiment illustrated in FIG. 1, the heat sink 105 comprises a series of fins, some of which are shorter than others to form a recessed area 107 for mounting a power supply (not shown). In alternate embodiments, a power supply can be mounted in other locations.

The heat sink 105 is coupled to rails 115 and 120. Heat sink 105 can be coupled to rails 115 and 120 using any of a variety of fasteners including screws, pins, and latches. Rail 115 comprises internal channels 116 and 117 and rail 120 comprises internal channels 121 and 122. In alternate embodiments, the rails can have greater or fewer channels. In the example modular illumination element 100, internal channel 116 and internal channel 121 accommodate an optical element 145 which slides along the channels and which comprises four Fresnel lenses. Each of the four Fresnel lenses is aligned with one of the four LEDs mounted on the printed circuit board 110. As shown in the example embodiment of FIG. 1, internal channels 117 and 122 can accommodate other optical elements such as a diffuser 128. Rails 115 and 120 also comprise external channels 118 and 123. External channels 118 and 123 can accommodate screws or other fasteners for attaching to a light fixture or other structure.

Figure 2:
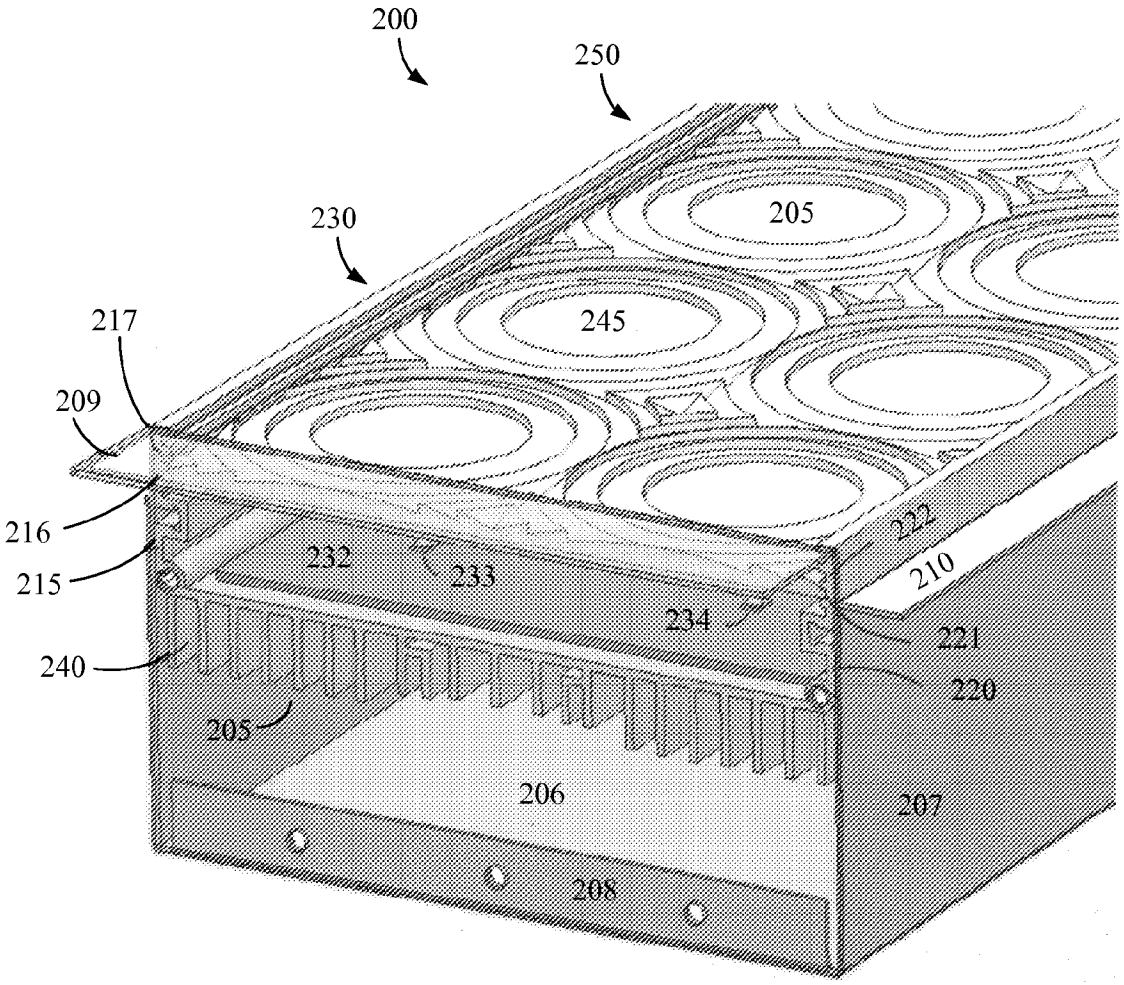
FIG. 2 is a perspective view of an array of modular illumination elements in accordance with an exemplary embodiment of this disclosure.

Referring now to FIG. 2, an exemplary array of illumination modules attached to a fixture 200 is illustrated. The fixture 200 comprises walls 205, 206 and 207 and tabs 208, 209 and 210. In the example shown in FIG. 2, tab 209 is shown as translucent so that the details of illumination module 220 can be seen, however, in practice, tab 209 typically is not translucent. The fixture also comprises rails 215 and 220 similar to the rails illustrated in FIG. 1. Rail 215 comprises internal channels 216 and 217 and rail 220 comprises internal channels 221 and 220.

Exemplary fixture 200 also comprises illumination module 230 and illumination module 250. Illumination module 230 comprises printed circuit board 232 on which are mounted four LEDs, two of which, 233 and 234, are visible in FIG. 2. Printed circuit board 232 is mounted onto heat sink 240 which comprises fins for drawing away heat from the printed circuit board. Illumination module 230 further comprises optical element 245 seated in internal channels 216 and 221. Illumination module 250 similarly comprises a printed circuit board mounted on a heat sink, the printed circuit board mounted with LEDs which are not visible in FIG. 2. Optical element 265 of illumination module 250 is also seated in internal channels 216 and 221. Optical elements 245 and 265 shown in exemplary fixture 200 each comprise four Fresnel lens aligned with each of the four LEDs mounted on each module's printed circuit board. Fresnel lenses can be used to focus the light emitted from each LED. Although not shown in FIG. 2, an additional optical element, such as a diffuser, can be seated in internal channels 217 and 222 for each of the illumination modules. Diffusers can be used to soften or scatter the focused light emitted from each Fresnel lens.

Although not shown in FIG. 2, a power supply can be mounted to the heat sink 240 and supply power to illumination module 230. A first electrical connector (not shown) can connect the power supply to the printed circuit board 232 of illumination module 230 and permit the flow of power from the power supply to the LEDs mounted on printed circuit board 232. A second electrical connector (not shown) can connect printed circuit board 232 to the printed circuit board of illumination module 250 so that power can be fed to the printed circuit of illumination module 250. Additional connectors can be used to connect other illumination modules so that a single power supply can provide power to an array of illumination modules. The connection of illumination modules is illustrated and described further herein in connection with FIGS. 8-10.

Figure 4:
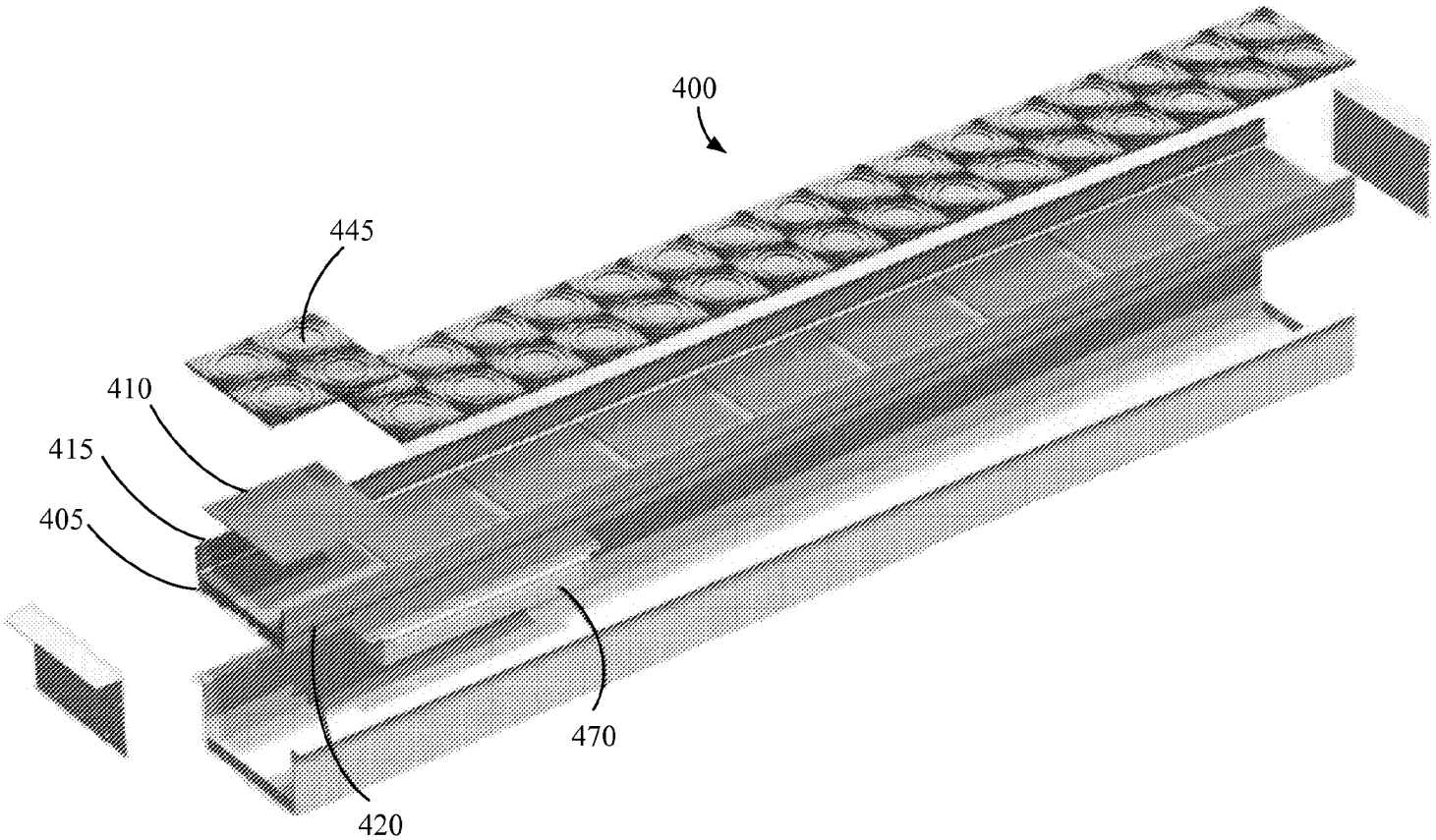
FIG. 4 is a perspective exploded view of an array of modular illumination elements in accordance with an exemplary embodiment of this disclosure.

Referring now to FIG. 4, an exploded view of an exemplary light fixture 400 with an array of illumination modules is shown. As illustrated in FIG. 4, the array of illumination modules is expandable to provide a row that is readily length customized to meet installation or application dictates. FIG. 4 illustrates, in exploded view, a line of nine circuit boards, one of which is labeled 410, each circuit board having four LEDs. The heat sink 405 onto which the circuit boards are mounted can be either nine individual heat sinks or one continuous heat sink attached to all nine circuit boards. The heat sink or heat sinks can be attached to rails 415 and 420. Exemplary embodiment 400 also illustrates nine optical elements, one of which is labeled 445. The optical elements can fit into channels in rails 415 and 420 and are disposed over the LEDs. The exemplary embodiment shown in FIG. 4 also illustrates a power supply 470 mounted to one side of the heat sink. As explained previously, in alternate embodiments, the power supply can be located in other positions.

Figure 3:
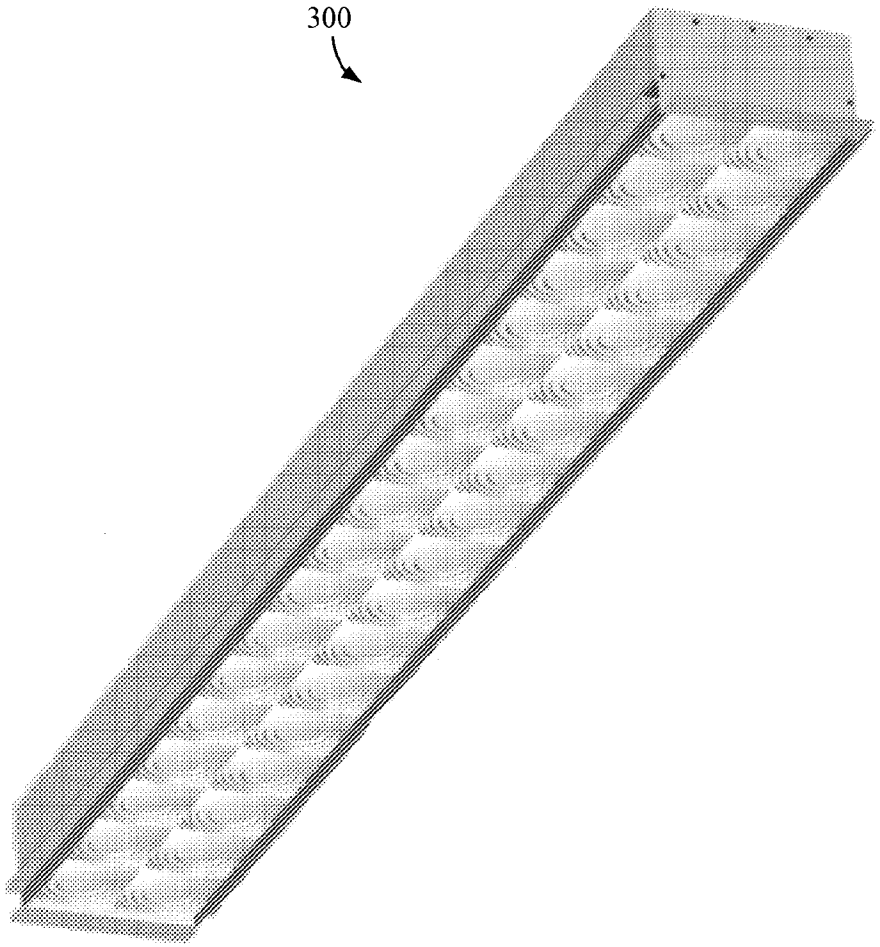
FIG. 3 is a perspective view of an array of modular illumination elements in accordance with an exemplary embodiment of this disclosure.
Figure 5:
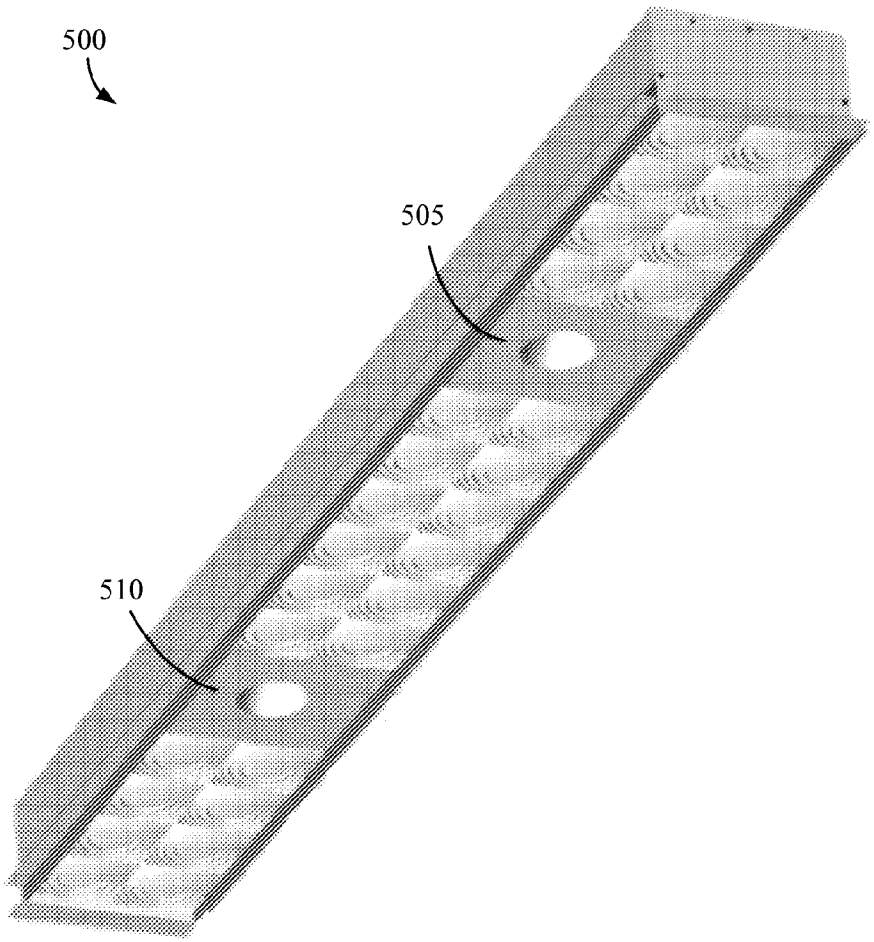
FIG. 5 is a perspective view of an array of modular illumination elements in accordance with another exemplary embodiment of this disclosure.

Referring now to FIGS. 3 and 5, fully assembled light fixtures 300 and 500 are illustrated, each fixture comprising an array of illumination modules similar to those described in connection with the previous Figures. Fixture 300 in FIG. 3 comprises an array of nine illumination modules similar to the previously described illumination modules. Fixture 500 of FIG. 5 comprises an array of seven illumination modules and two spot lights 505 and 510. As shown in FIG. 5, the arrays of illumination modules described herein can be interspersed with other types of lighting systems.

One of the advantages to using the illumination modules described in FIGS. 1-5 is that it facilitates retrofitting existing lighting fixtures that do not use LED technology. For example, fluorescent light bulbs can be removed from the fixtures shown in FIGS. 2-5 and replaced with the LED illumination modules described herein. As one example, the array of illumination modules can be configured for compatibility and compliance with the ceiling lighting system marketed by Armstrong World Industries under the identifier "TECHZONE." The shape of the illumination modules described herein facilitates fitting arrays of the illumination modules into a variety of different types of light fixtures. The size and modular nature of the illumination modules also provides an efficient and cost-effective approach for retrofitting existing light fixtures.

Figure 6:
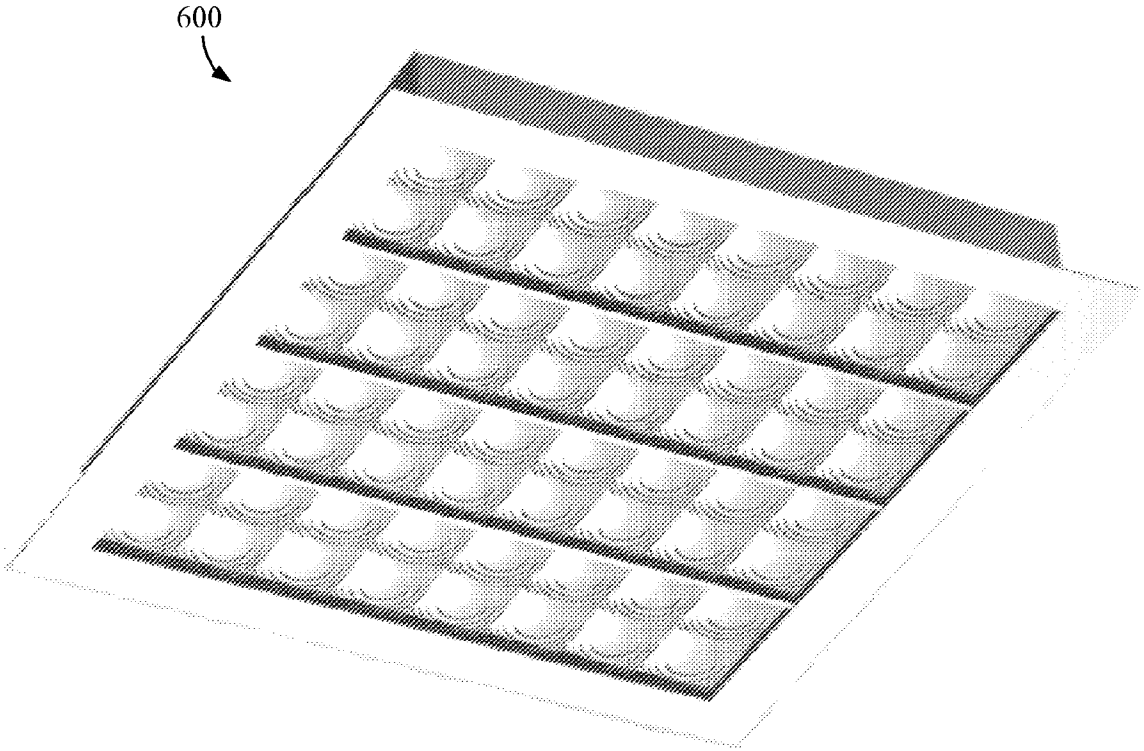
FIG. 6 is a perspective view of an array of modular illumination elements in accordance with another exemplary embodiment of this disclosure.
Figure 7:
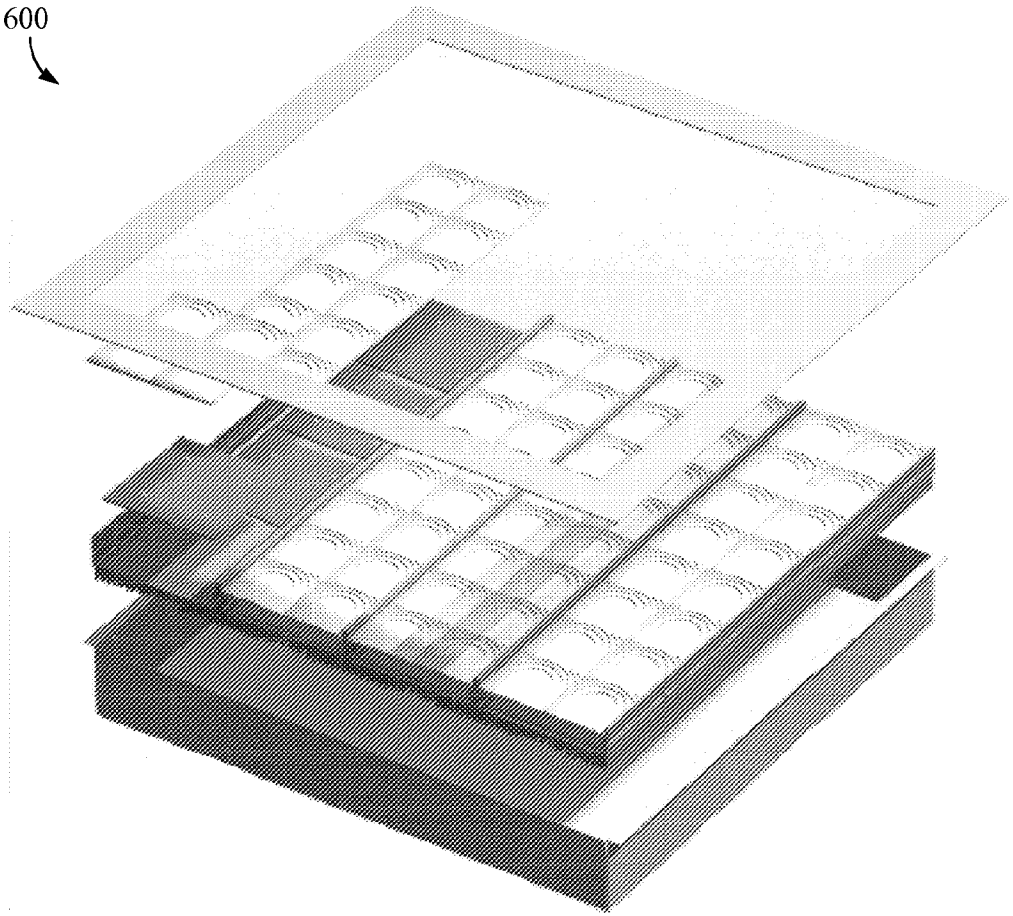
FIG. 7 is an exploded perspective view of an array of modular illumination elements in accordance with another exemplary embodiment of this disclosure.

Referring now to FIGS. 6 and 7, another exemplary embodiment is shown. FIG. 6 shows light fixture 600 with a square array of illumination modules. FIG. 7 provides an exploded view of fixture 600 illustrating the components of each illumination module in the square array. Similar to the illumination modules described in connection with FIGS. 1-5, each illumination module comprises a heat sink, a printed circuit board with one or more LEDs, and an optical element, such as one or more lenses that focus the light emitted from the LEDs. As described previously, the heat sink can be one continuous component onto which multiple printed circuit boards are mounted or, alternatively, each illumination module can have a distinct heat sink component. The square array in light fixture 600 also uses a similar system of rails to which each illumination module is attached. Light fixture 600 is different from the previously described embodiments in that it comprises multiple pairs of rails sitting side-by-side to form the square array of illumination modules. Those of skill in the art will recognize that other shapes and configurations of the illumination modules are also possible.

Figure 8:
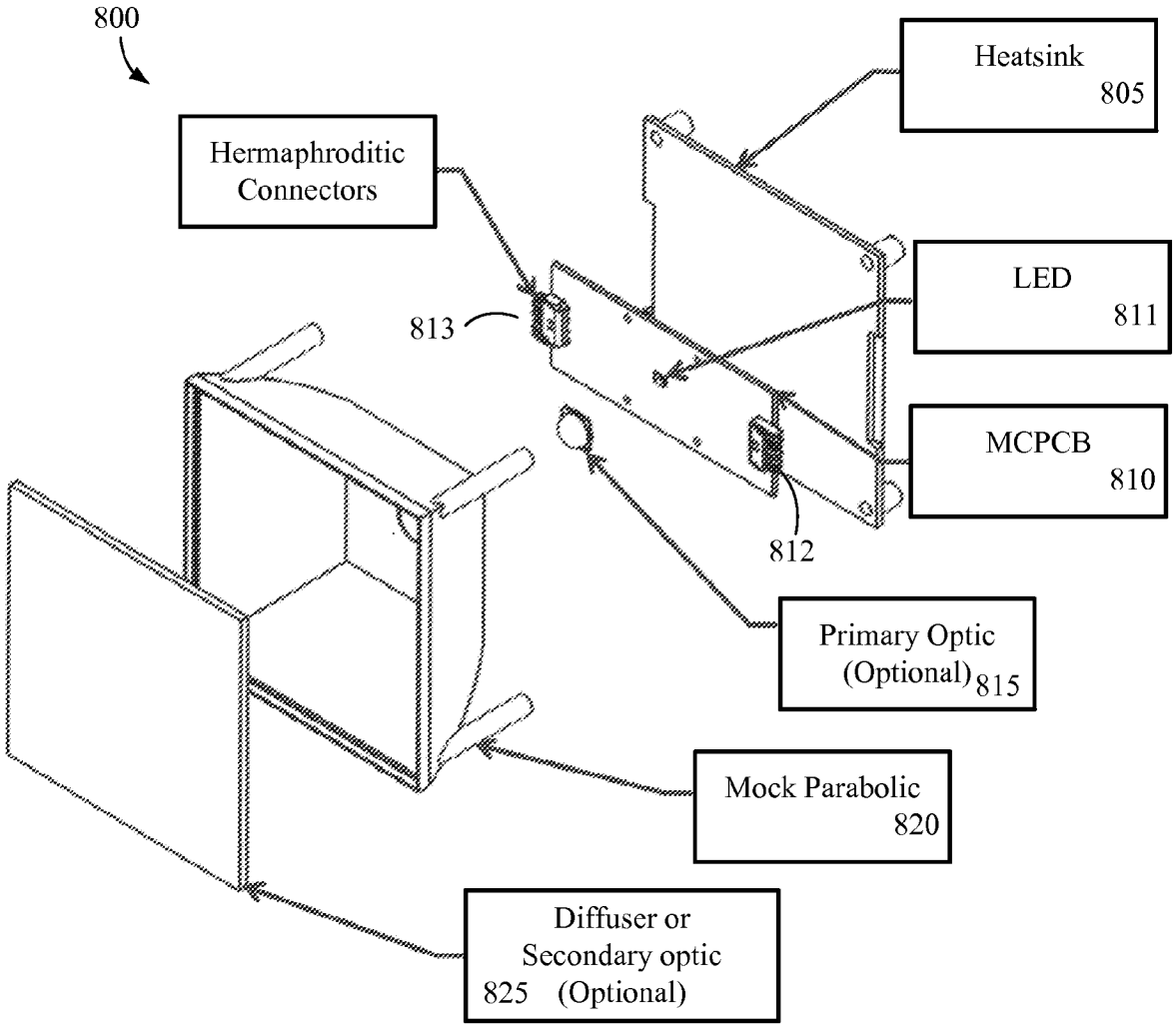
FIG. 8 is an exploded view of a modular illumination element in accordance with another exemplary embodiment of this disclosure.
Figure 8A:
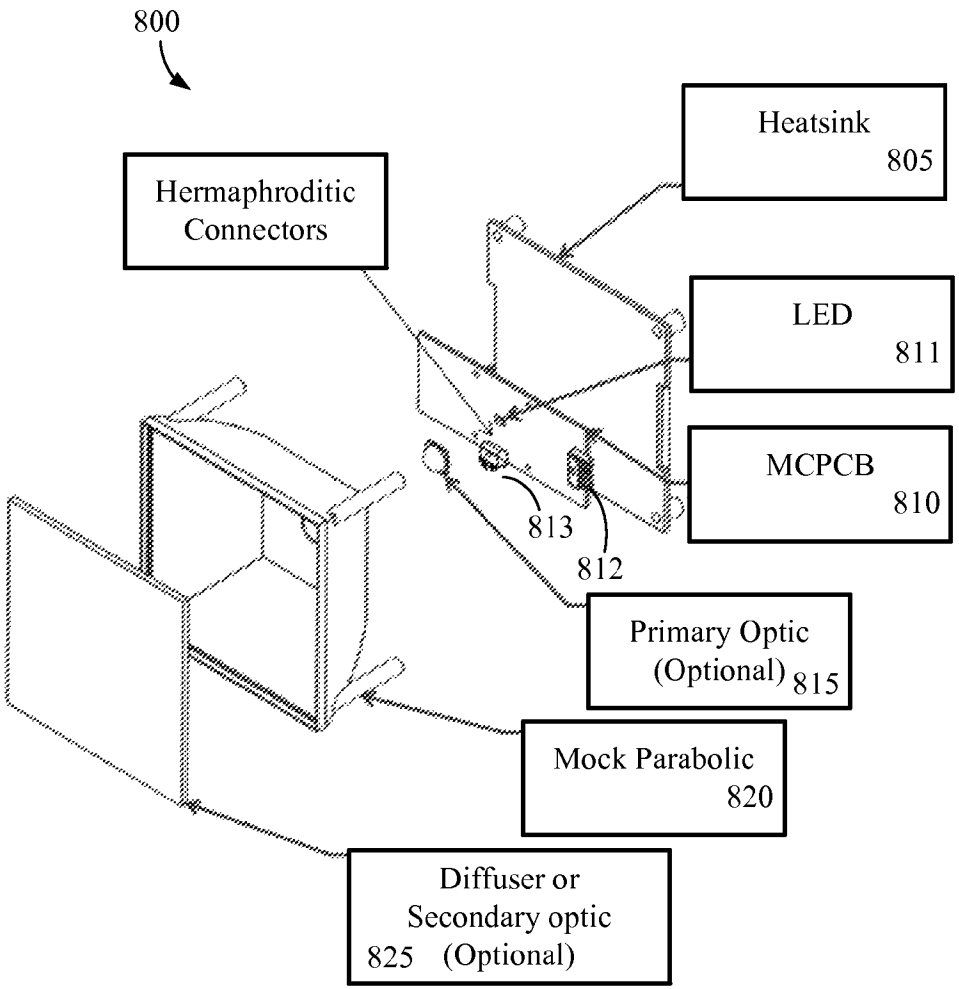
FIG. 8A is another exploded view of a modular illumination element in accordance with another exemplary embodiment of this disclosure.
Figure 9:
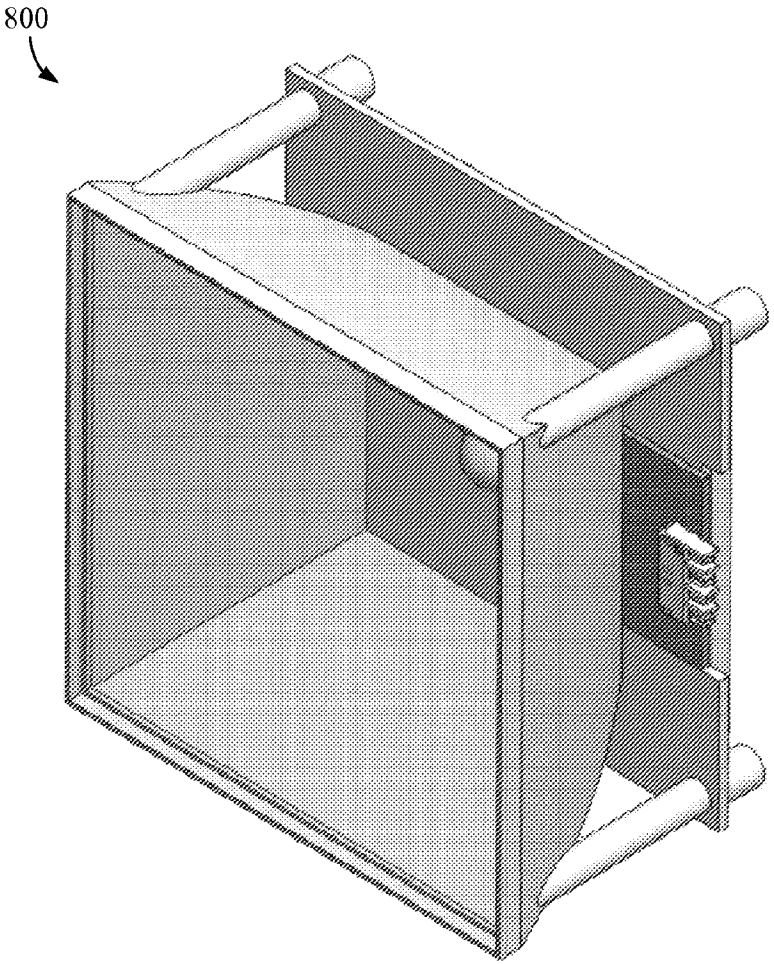
FIG. 9 is a perspective view of a modular illumination element in accordance with another exemplary embodiment of this disclosure.

Referring now to FIG. 8, an exploded view of another illumination module 800 in accordance with an exemplary embodiment is illustrated. FIG. 9 shows an assembled view of the illumination module 800 without the plate of optical material 825. Illumination module 800 comprises a heat sink 805 to which is mounted a printed circuit board 810 comprising LED 811. In alternate embodiments multiple LEDs can be mounted to the printed circuit board. Two hermaphroditic connectors 812 and 813 are attached to the printed circuit board 810, one on each opposite edge of the printed circuit board 810. In certain embodiments, as shown in FIG. 8A, the two hermaphroditic connectors can be attached to adjacent edges of the printed circuit board 810. In certain embodiments, three or four hermaphroditic connectors can be attached to the printed circuit board, for example one per circuit board edge.

A primary optic 815 also is mounted to the printed circuit board 810 to receive and process light from the LED 811. The primary optic 815 can transfer the pattern of light emanating from the LED 811 into a desired form, for example a beam having a substantially square or rectangular format in cross section. In certain embodiments, the primary optic 815 incorporates technology as disclosed in U.S. Pat. No. 7,674,018, which is referenced above and the entire contents of which is incorporated herein by reference. Accordingly, the primary optic 815 illustrated in FIG. 8 can comprise any of the optic embodiments and/or teaching or technologies disclosed in U.S. Pat. No. 7,674,018. Moreover, one of ordinary skill in the art having benefit of the present disclosure can apply the teachings of U.S. Pat. No. 7,674,018 so that the primary optic illustrated in FIG. 8 produces a beam having a substantially square or rectangular form in cross section with a defined or specified intensity profile across that cross section.

The primary optic 815 is disposed at an entrance opening to a mock parabolic housing 820 in FIG. 8. In the illustrated embodiment, the mock parabolic housing 820 includes an interior having a reflective surface that receives and reflects light emitted from the primary optic 815. In an exemplary embodiment, the cavity of the mock parabolic housing 820 has a geometric form at least part of which resembles or follows a parabola or a conic section. In certain embodiments, the mock parabolic is opaque and prevents light from transmitting between two adjacent illumination modules. In certain embodiments, the exit aperture of the mock parabolic truncates, eliminates, clips, or otherwise manipulates part of the beam of light produced by the primary optic 815.

In the exemplary embodiment illustrated in FIG. 8, a plate of optical material 825 covers the exit aperture of the mock parabolic. In one embodiment, the plate of optical material comprises a secondary optic, such as a Fresnel lens. In another exemplary embodiment, the plate of optical material comprises a diffuser. In yet another exemplary embodiment, the plate of optical material comprises a Fresnel lens facing the primary optic 815 and diffusion features etched or otherwise formed on an outer surface of the plate. As referenced above, FIG. 9 illustrates the components of FIG. 8 in assembled form, but without the plate of optical material 825.

Figure 10:
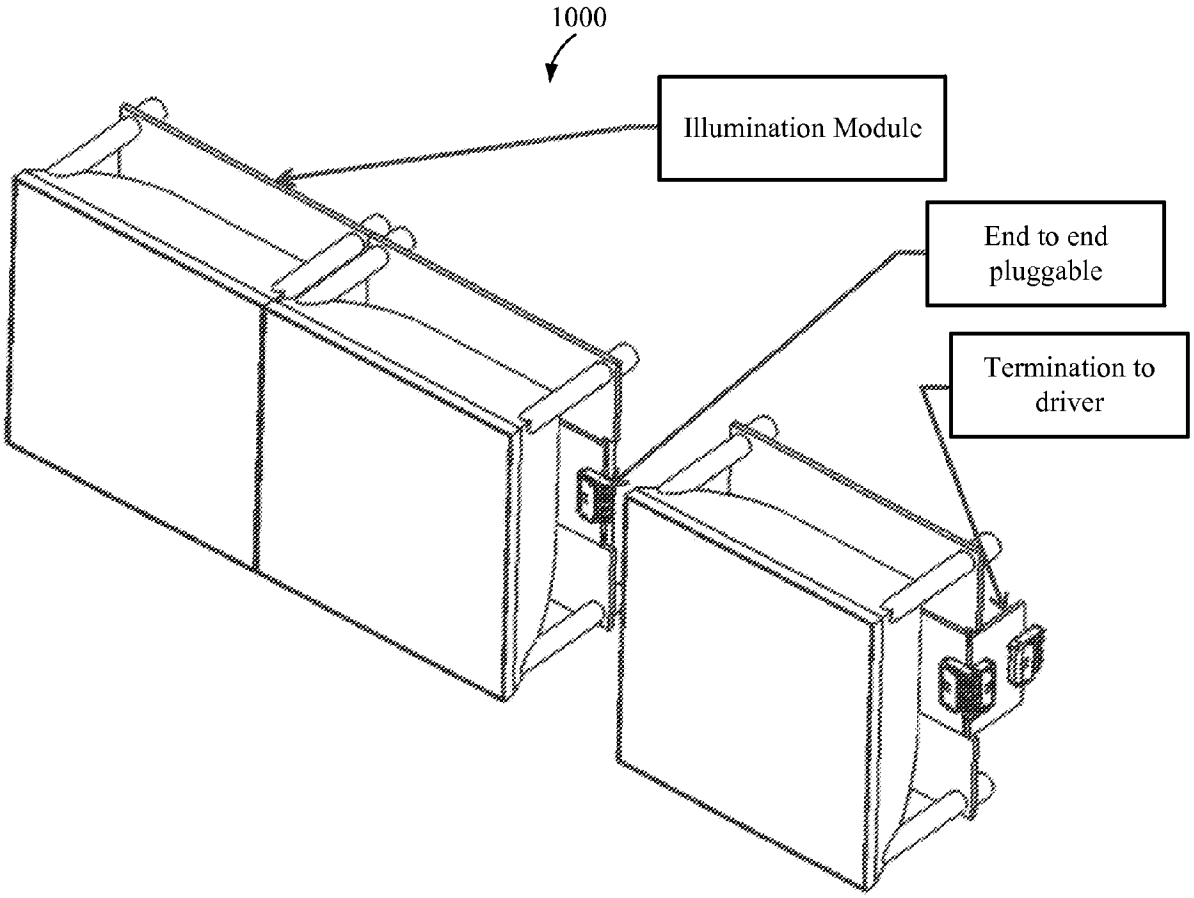
FIG. 10 is a perspective view of an array of modular illumination elements in accordance with another exemplary embodiment of this disclosure.

Referring now to FIG. 10, another exemplary embodiment 1000 illustrates forming an array of the illumination modules by mating together the hermaphroditic connectors of adjacent illumination modules. In this manner, electricity can flow from a driver circuit to multiple illumination modules to power the LEDs of each illumination module. In the embodiment illustrated in FIG. 10, each printed circuit board has two hermaphroditic connectors, one on each opposite end enabling the illumination modules to be connected in a one-dimensional array. In alternate embodiments, connectors can be arranged along other edges of the printed circuit board so that the illumination modules can be connected in two-dimensional arrays or other arrangements.

Figure 11:
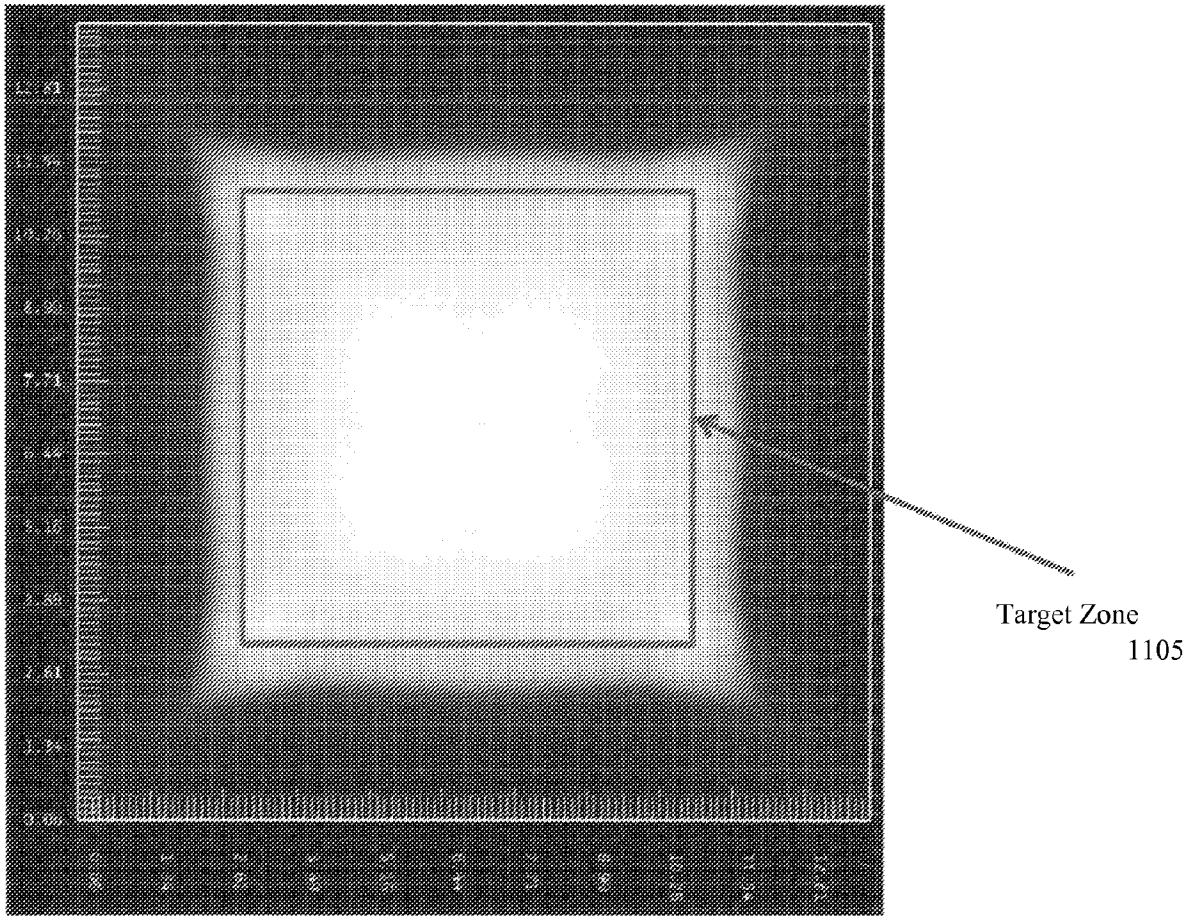
FIG. 11 is an illustration of an illumination pattern.
Figure 12:
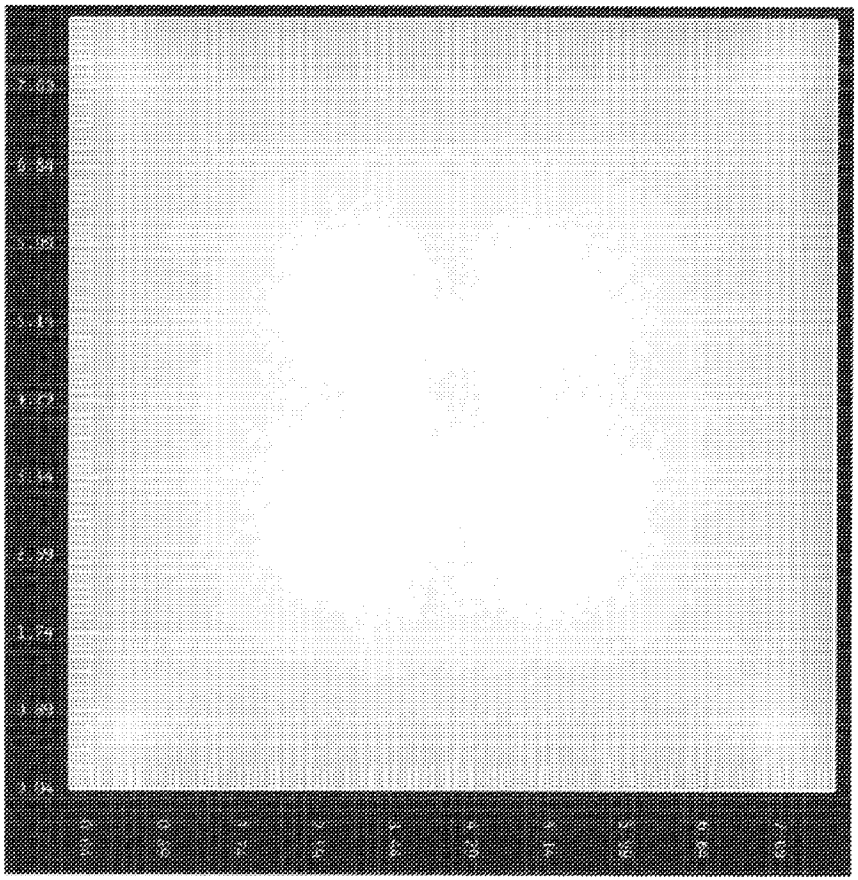
FIG. 12 is an illustration of an illumination pattern in accordance with an exemplary embodiment of this disclosure.

FIG. 11 illustrates a simulated illumination pattern as produced by the illumination module illustrated in FIGS. 8 and 9 and discussed above. The illumination pattern slightly overfills the target zone 1105. Accordingly, the exit aperture of the illumination module can clip or eliminate the edges of the illumination pattern, to facilitate a fully filled aperture providing ambient light that is uniform, consistent, and aesthetically pleasing. For example, the mock parabolic housing 820 described in connection with FIG. 8 can be used to fold the edges of the illumination pattern shown in FIG. 11 back inward to produce the more consistent and uniform illumination pattern illustrated in FIG. 12. FIG. 12 illustrates a simulated illumination pattern demonstrating consistency and uniformity as can be provided by the illumination modules described herein.

The embodiments described herein are illustrative and not restrictive. It should be appreciated by those skilled in the art that various modifications are well within the scope of the invention. From the foregoing, it will be appreciated that the embodiments overcome limitations in the prior art. From the description of the exemplary embodiments, equivalents of the elements shown therein will suggest themselves to those skilled in the art, and ways of constructing other embodiments will suggest themselves to practitioners of the art. Therefore, the scope of the disclosure is not limited to the examples provided herein.

What is claimed is:

1. A modular illumination system comprising:

an array of illumination modules, each comprising:

a circuit board;

a first electrical connector mounted at an edge of the circuit board;

a second electrical connector mounted at another edge of the circuit board;

a light emitting diode mounted to a face of the circuit board;

a primary optic mounted to the face of the circuit board over the light emitting diode and disposed at an entrance opening of a concave reflector, wherein the primary optic is oriented to receive light from the light emitting diode; and a secondary optic disposed at an aperture of the concave reflector which is opposite to the entrance opening of the concave reflector such that the secondary optic covers the aperture, wherein the array of illumination modules comprises a first illumination module and a second illumination module adjacent one another, and wherein the second electrical connector of the first illumination module mates with the first electrical connector of the second illumination module.

2. The modular illumination system of claim 1, wherein the first electrical connector of the first illumination module is operative to receive power from a power source, wherein the circuit board of the first illumination module is operative to feed power from the first electrical connector of the first illumination module to the light emitting diode of the first illumination module and to the second electrical connector of the first illumination module, wherein the first electrical connector of the second illumination module is operative to receive power from the second electrical connector of the first illumination module, and wherein the circuit board of the second illumination module is operative to feed power from the first electrical connector of the second illumination module to the light emitting diode of the second illumination module and to the second electrical connector of the second illumination module.

3. The modular illumination system of claim 1, wherein the edge and the another edge are opposite one another.

4. The modular illumination system of claim 1, wherein the edge and the another edge meet at a corner of the circuit board.

5. The modular illumination system of claim 1, wherein the concave reflector comprises an opaque member extending around a perimeter of the illumination module and circumferentially surrounding a pattern of light emitted by the primary optic.

6. The modular illumination system of claim 1, wherein the primary optic comprises a lens that produces a pattern of emitted light extending away from the face of the circuit board, wherein the concave reflector comprises:

a reflective surface extending circumferentially around the pattern of emitted light and providing the aperture, and wherein the secondary optic is a Fresnel lens facing the primary optic and has diffusion features etched on a surface of the Fresnel lens.

7. The modular illumination system of claim 1, wherein the first electrical connector of each illumination module is hermaphroditic, and wherein the second electrical connector of each illumination module is hermaphroditic.

8. The modular illumination system of claim 1, wherein the array of illumination modules comprises a two-dimensional array of illumination modules.

9. The modular illumination system of claim 1, wherein each illumination module comprises a housing that blocks light from transmitting between adjoining illumination modules of the array.

10. A modular illumination system comprising:

a two-dimensional array of illumination modules, each comprising:

a circuit board comprising a face;

a light emitting diode mounted on the face;

a primary lens mounted on the circuit board over the light emitting diode and disposed at an entrance opening of a concave reflector; wherein the primary lens is oriented to receive light emitted by the light emitting diode;

the concave reflector comprising:

a cavity oriented to receive light that the lens receives and emits;

a reflective surface lining the cavity; and an aperture opposite the primary lens and opposite the entrance opening of the concave reflector; and a second lens covering the aperture.

11. The modular illumination system of claim 10, wherein the second lens comprises a Fresnel lens.

12. The modular illumination system of claim 10, wherein the two-dimensional array of illumination modules is adapted for ceiling mounting.

13. The modular illumination system of claim 10, wherein each illumination module of the two-dimensional array of illumination modules comprises:

a first electrical connector attached at an edge of the circuit board; and a second electrical connector attached at another edge of the circuit board.

14. The modular illumination system of claim 13, wherein a first illumination module is connected to a power source by the first electrical connector of the first illumination module; and the second electrical connector of the first illumination module is coupled to the first electrical connector of a second illumination module.

15. A light fixture comprising:

a housing comprising at least two rails, each rail comprising:

one or more internal channels; and one or more external channels adapted to accommodate fasteners for attaching to another structure; and an array of illumination modules, each illumination module comprising:

a circuit board on which is mounted a light emitting diode;

a first electrical connector attached at an edge of the circuit board;

a second electrical connector attached at another edge of the circuit board;

an optic oriented to receive light from the light emitting diode, wherein the array of illumination modules comprises a first illumination module and a second illumination module adjacent one another, and wherein the second electrical connector of the first illumination module connects to the first electrical connector of the second illumination module; and a heat sink that is attached to the circuit board and comprising a series of fins, some of which are shorter than the others to form a recessed area adapted to mount a power supply.

16. The light fixture of claim 15, wherein the optic is disposed in a first channel of a first rail and a first channel of a second rail.

17. The light fixture of claim 16, further comprising a heat sink upon which the array of illumination modules are mounted, the heat sink attached to the first rail and the second rail.

18. The light fixture of claim 16, further comprising a diffuser disposed in a second channel of the first rail and a second channel of the second rail.

19. The light fixture of claim 16, wherein the first rail and the second rail attach to a light fixture.

* * * * *